US008713829B1

(12) United States Patent
Crofford

(10) Patent No.: US 8,713,829 B1
(45) Date of Patent: May 6, 2014

(54) TEMPORARY REUSABLE SIGN APPARATUS

(71) Applicant: Donald Crofford, Amarillo, TX (US)

(72) Inventor: Donald Crofford, Amarillo, TX (US)

( * ) Notice: Subject to any disclaimer, the term of this patent is extended or adjusted under 35 U.S.C. 154(b) by 0 days.

(21) Appl. No.: 13/753,505

(22) Filed: Jan. 29, 2013

(51) Int. Cl.
*G09F 15/00* (2006.01)

(52) U.S. Cl.
USPC ..... 40/607.01; 40/607.12

(58) Field of Classification Search
USPC ..... 40/305, 306, 652, 310, 664, 663; 24/3.12; 248/218.4–219.4; 434/408, 434/416, 421, 422; 401/195
See application file for complete search history.

(56) References Cited

U.S. PATENT DOCUMENTS

| | | | | | |
|---|---|---|---|---|---|
| 204,736 | A | * | 6/1878 | Housum et al. | 606/117 |
| 491,136 | A | * | 2/1893 | Rosenblatt et al. | 206/480 |
| 1,786,883 | A | | 12/1930 | Zahonyi | |
| 2,020,780 | A | * | 11/1935 | Hamilton | 40/310 |
| 2,262,873 | A | * | 11/1941 | Wise | 40/607.12 |
| 3,638,894 | A | | 2/1972 | Leutenegger | |
| 3,729,847 | A | | 5/1973 | Chandos | |
| 3,822,783 | A | * | 7/1974 | Mortensen | 206/480 |
| 3,961,852 | A | * | 6/1976 | Parry | 401/195 |
| 4,246,715 | A | | 1/1981 | Nelson | |
| 4,722,145 | A | * | 2/1988 | Prest | 40/584 |
| 5,088,672 | A | | 2/1992 | Neuendorf et al. | |
| 5,727,818 | A | * | 3/1998 | Schmeida | 283/81 |
| 6,186,454 | B1 | | 2/2001 | Olsen | |
| 6,829,853 | B2 | | 12/2004 | Kim | |
| 6,976,660 | B2 | | 12/2005 | Lapointe et al. | |
| D541,346 | S | * | 4/2007 | Lau | D19/65 |
| 7,431,590 | B2 | * | 10/2008 | Gerhardt | 434/408 |
| 7,506,466 | B2 | | 3/2009 | Betham et al. | |
| D648,620 | S | | 11/2011 | Wagner | |
| 2007/0035699 | A1 | * | 2/2007 | McKee | 352/90 |

FOREIGN PATENT DOCUMENTS

| | | | |
|---|---|---|---|
| JP | 09099695 | A * | 4/1997 |
| JP | 2004042403 | A * | 2/2004 |

* cited by examiner

*Primary Examiner* — Casandra Davis
(74) *Attorney, Agent, or Firm* — Karl L. Larson

(57) ABSTRACT

A temporary reusable sign apparatus that includes a substantially flat sign board having one or more openings and front and rear sides, and a securing means for securing the substantially flat sign board to a supporting structure. The front side includes a dry-eraseable marker surface configured to receive one or more indicia. The securing means is configured to deflectably receive and thereby frictionaly engage a portion of the supporting structure.

17 Claims, 6 Drawing Sheets

TEMPORARY REUSABLE SIGN APPARATUS

BACKGROUND OF THE INVENTION

1. Field of the Invention

The present invention is generally related to banners and/or signs, and more particularly to a temporary reusable sign apparatus.

2. Discussion of the Background

Temporary signs are often used to advertise something or post notice regarding an event, such as, without limitation, a garage sale, home sale or other sale, an open house, a party or function, a lost animal, and the like. These temporary signs are often attached to street and stop signs, telephone poles, and the like by means of nails, staples, screws and the like. Because these temporary signs are typically attached by means of nails, staples, screws and the like, they are often difficult to remove and because of this often not removed when the advertisement and/or event notice is no longer needed. Temporary signs known in the prior art thus often become an eye sore or unnecessary trash.

A typical temporary sign is made of some form of paper, such as poster board, cardboard, stationary paper, and the like, or a thin piece of plastic. Because a typical temporary sign known in the prior art is not made of a hardened material, it is typically prone to collapsing or being shredded in the wind. Further, temporary signs known in the prior art are susceptible to weather elements, such as rain, sleet, mud, and the like.

Thus, there currently exist deficiencies associated with banners and/or signs generally, and, in particular, with temporary reusable signs.

SUMMARY OF THE INVENTION

Accordingly, one aspect of the present invention is to provide a temporary reusable sign apparatus that includes a substantially flat sign board having one or more openings and front and rear sides, and a securing means for securing the substantially flat sign board to a supporting structure. The front side includes a dry-eraseable marker surface configured to receive one or more indicia. The securing means is configured to deflectably receive and thereby frictionaly engage a portion of the supporting structure.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTION OF THE PREFERRED EMBODIMENTS

Figure 1A:
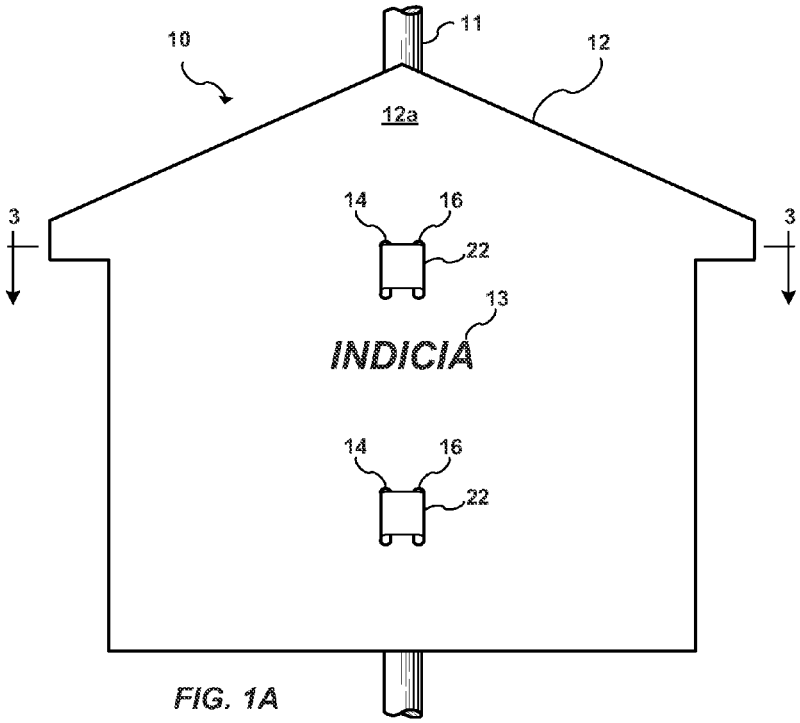
FIG. 1A shows a front view of a temporary reusable sign apparatus in accordance with an embodiment of the present invention.
Figure 1B:
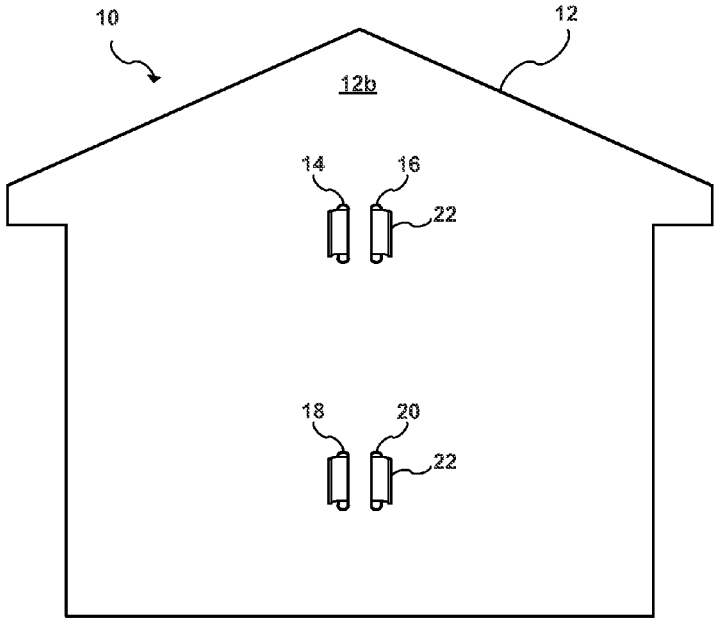
FIG. 1B shows a rear view of the temporary reusable sign apparatus of FIG. 1A in accordance with an embodiment of the present invention.
Figure 1C:
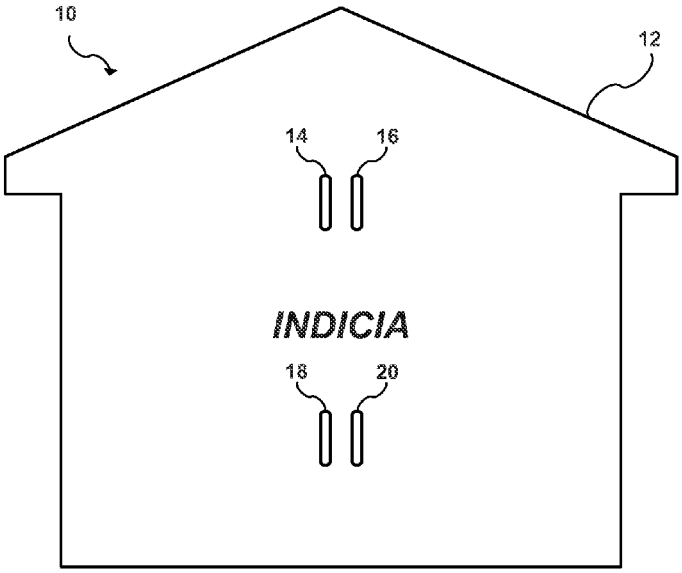
FIG. 1C shows a front view of the temporary reusable sign apparatus of FIG. 1A without securing means in accordance with an embodiment of the present invention.

Referring now to the drawings, wherein like reference numerals designate identical or corresponding parts throughout the several views, preferred embodiments of the present invention are described.

The present invention relates to a temporary reusable sign apparatus that temporarily attaches to a stationary structure during an operational use. As used herein, a stationary structure refers to, without limitation, a street sign, a stop sign, a telephone pole, other types of poles, a pipe, a stationary structure, a tree, and the like. The temporary reusable sign apparatus is composed of a hardened material that is configured to withstand the wind without collapsing and a securing means for securing the rear of the sign to a stationary structure. The securing means may be any suitable connecting means. According to one embodiment, the securing means is comprised of a portion of a PVC pipe which runs through the temporary reusable sign and that deflectably connects to a post, tree or other stationary object. However, it is understood that other deflectable materials, clips or other attachment means could be used instead of the PVC pipe portion within the scope of the present invention. After an operational use, the temporary reusable sign apparatus may be later removed from the post, tree or other stationary object. According to one embodiment, the temporary reusable sign apparatus includes a dry erase marker surface which a user may use to write indicia thereupon. Such indicia may include information about an event, such as, without limitation, a garage sale, home sale or other sale, an open house, a party or function, a lost animal, and the like.

Referring to FIGS. 1A-1F, a temporary reusable sign apparatus 10 in accordance with an embodiment of the present invention is shown. According to this embodiment, the reusable sign apparatus 10 includes a sign board 12 and a securing means 22. Sign board 12 includes a front side 12*a*, a rear side 12*b*, and one or more openings (14, 16, 18 and 20). The rear side 12*b* of the sign board 12 is composed of a hardened material that won't collapse in the wind. At least a portion of the front side of sign board 12 is composed of a surface capable of receiving markings from a dry erase marker to write the information, and which is easily erasable.

Figure 1F:
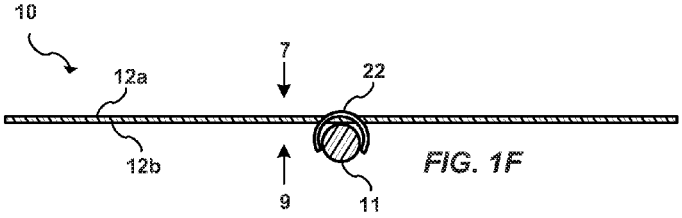
FIG. 1F shows a top view of the temporary reusable sign apparatus taken approximately along the line 3-3 of FIG. 1A in accordance with an embodiment of the present invention.

The one or more securing means 22 are configured, in operation, to receive a stationary structure 11. After receiving the stationary structure 11, the one or more securing means 22 frictionally engage the stationary structure 11 and thereby secure the temporary reusable sign apparatus 10 to the stationary structure 11. The one or more securing means 22 may be any suitable connecting means. According to one embodiment, as shown in FIGS. 1F and 3A-3C, the one or more securing means 22 are each comprised of a portion of a PVC pipe formed into a substantially c-shape having two curved distal end portions which define an opening. The two curved distal end portions of the one or more securing means 22 are configured to be inserted through corresponding two of the one or more openings (14, 16, 18 and 20) on the front side 12*a* of the sign board such that the two curved distal end portions of the one or more securing means 22 extend through and beyond the rear side 12*a* of the sign board 12. In an operational use, the reusable sign 10 is attached to a stationary object 11. To attach the reusable sign 10 to the stationary object 11, the reusable sign 10 is pushed in direction 7 (as shown in FIG. 1F) towards the stationary object 11. The two curved distal end portions of the one or more securing means 22 are configured, in operation, to deflectably receive through the opening and thereby frictionally engage at least a portion of the stationary structure 11.

Figure 7A:
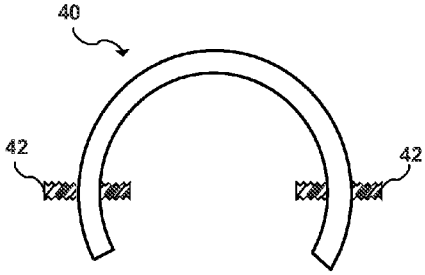
FIG. 7A shows a top view of a securing means in accordance with an alternate embodiment of the present invention.
Figure 7C:
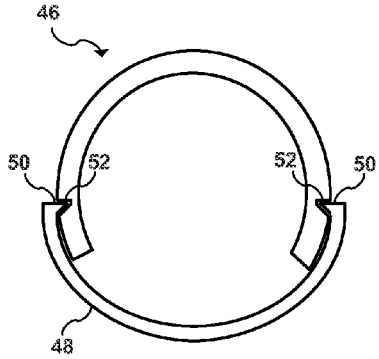
FIG. 7C shows a top view of a securing means in accordance with an alternate embodiment of the present invention.
Figure 7B:
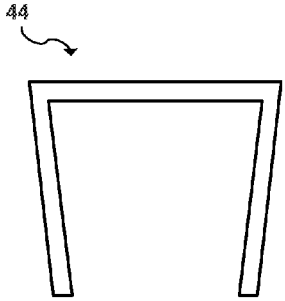
FIG. 7B shows a top view of a securing means in accordance with an alternate embodiment of the present invention.

However, it is understood that any other deflectable material, clip or other attachment means could be used instead of the PVC pipe within the scope of the present invention. For instance, without limitation, other types of alternate connectors are shown in FIGS. 7A-7C. Referring to FIG. 7A, a top view of a securing means 40 having one or more locking screws 42 in accordance with an alternate embodiment of the present invention is shown. According to this embodiment, the securing means 40 includes one or more locking screws 42 which are tightened to provide additional locking capabilities to the stationary object 11 in an operational use. Referring to FIG. 7C, a top view of a securing means 46 having a locking cap 48 in accordance with an alternate embodiment of the present invention is shown. According to this embodiment, the locking cap 48 includes one or more protruding portions 50 which are inserted into one or more respective indentions 52 included on the securing means 46. As such, the locking cap 48 is used to provide additional locking capabilities to the stationary object 11 in an operational use. However, it is under understood that other types of locking means may be used within the scope of the present invention. Referring to FIG. 7B, a top view of a securing means 44 in accordance with an alternate embodiment of the present invention is shown. According to this embodiment, the securing means 44 includes a substantially flat connecting portion connecting two arms angled towards each other and configured to deflect in an operational use. The one or more securing means (22, 30, 34, and 36) may be comprised of plastic, metal, extruded materials, or the like.

It is understood that other types of deflectable materials, clips or other attachment means may be connected to the sign board 12 using fewer or more of the one or more openings (14, 16, 18 and 20) on the front side 12*a* of the sign board, or by other means without use of the one or more openings (14, 16, 18 and 20).

The front side 12*a* includes a display area adapted to receive indicia 13, such as, without limitation, dry-erasable markings. Indicia 13 may include information about an event, such as, without limitation, a garage sale, home sale or other sale, an open house, a party or function, a lost animal, and the like. Display indicia 13 may include text 13*a* and/or graphics 13*b*. According to one embodiment, the display area is comprised of a dry-erasable marker surface capable of receiving indicia 13 from a dry erase marker to write relevant information, and which is easily erasable. Examples of suitable dry-erasable marker surfaces include, without limitation, Pionite markerboard laminate, Formica® brand dry erase markerboard laminate, Claridge porcelain markerboard. According to other embodiments, the dry-erasable marker surface may also include, without limitation fiberglass (FRP), Masonite, fiberboard, metal, plastic, composite, extruded material, or the like. However, it is understood that any other type of dry-erasable marker surface is possible within the scope of the present invention. It is also understood that the indicia may include permanent and non-permanent text 13*a* and/or graphics 13*b*. For instance, the indicia may include markings from a permanent marker.

The rear side 12*b* of sign board 12 is a hardened material such as a high density fiberglass (FRP), Masonite, fiberboard, metal, plastic, composite, extruded material, or the like.

Figure 1E:
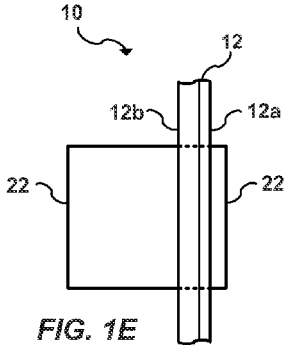
FIG. 1E shows an enlarged cut-away side view of the temporary reusable sign apparatus taken approximately at section 5 of FIG. 1D in accordance with an embodiment of the present invention
Figure 1D:
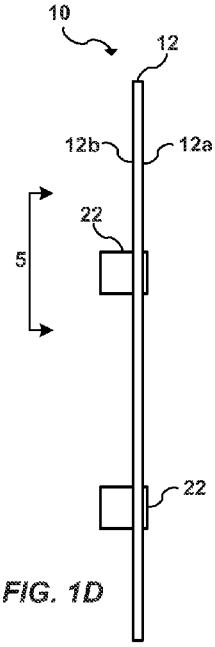
FIG. 1D shows a side view of the temporary reusable sign apparatus of FIG. 1A in accordance with an embodiment of the present invention.
Figure 2A:
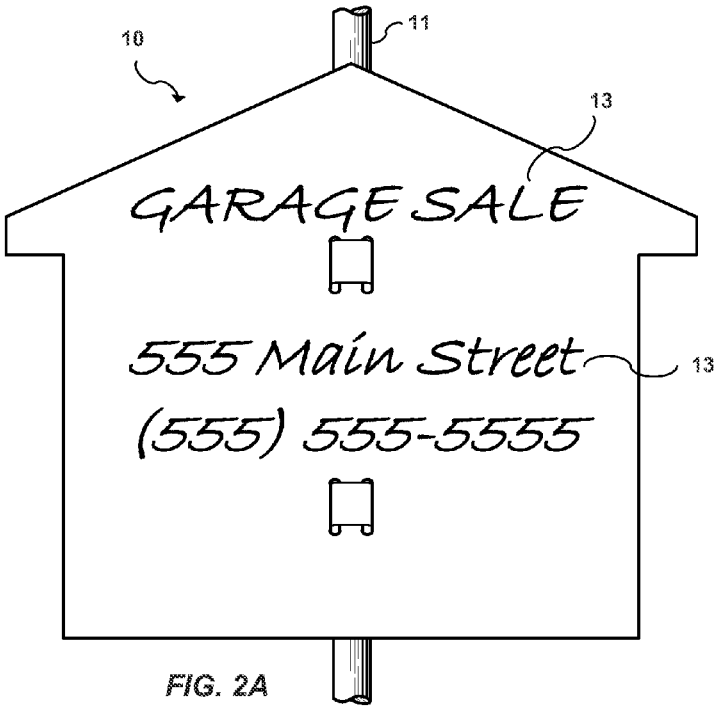
FIGS. 2A-2B show front views of the temporary reusable sign apparatus illustrating exemplary indicia in accordance with an embodiment of the present invention.
Figure 2B:
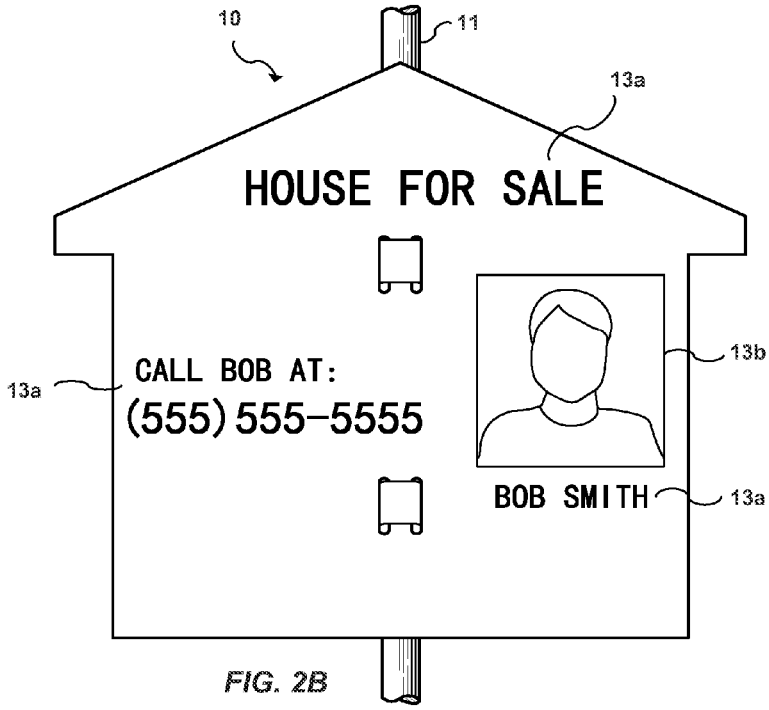
Figure 3A:
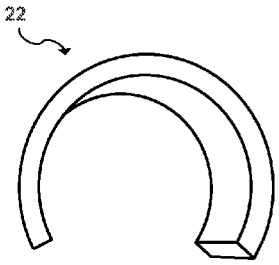
FIG. 3A shows a perspective view of a securing means in accordance with an embodiment of the present invention.
Figure 3B:
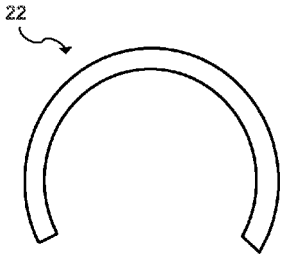
FIG. 3B shows a top view of a securing means of FIG. 3A in accordance with an embodiment of the present invention.
Figure 3C:
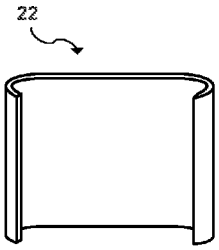
FIG. 3C shows a front view of a securing means of FIG. 3A in accordance with an embodiment of the present invention.
Figure 4A:
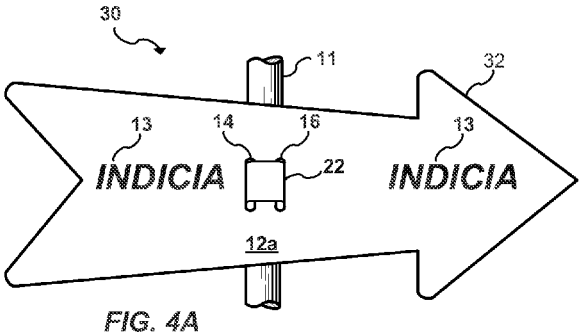
FIG. 4A shows a front view of a temporary reusable sign apparatus in accordance with an alternate embodiment of the present invention.
Figure 4B:
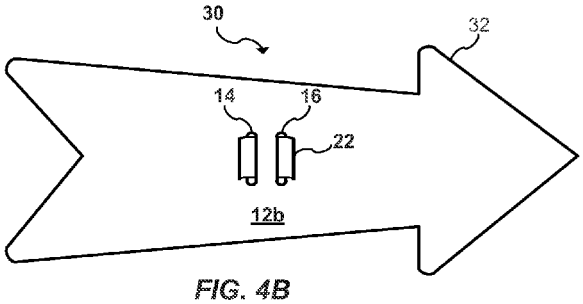
FIG. 4B shows a rear view of the temporary reusable sign apparatus of FIG. 4A in accordance with an alternate embodiment of the present invention.

Sign board 12 may be comprised of a unitary piece of material, or may be two or more pieces joined or fused together, or any other variation thereof. For example, and without limitation, front side 12*a* and rear side 12*b* are shown in FIG. 1E as two separate pieces joined together. They may be joined together by any suitable means including without limitation solvent or water-based contact cement, white glue (PVA), epoxy, semi-rigid adhesives (PVCc), rigid adhesives (urea, resorcinol), adhesive tape, Velcro®, magnets, or the like.

After its operational use, the reusable sign may be removed from the stationary object 11. To remove the reusable sign 10 from the stationary object 11, the reusable sign 10 is pulled in direction 9 (as shown in FIG. 1F) away from stationary object 11. The two curved distal end portions of the one or more securing means 22 are configured to deflect and allow the portion of the stationary structure that is frictionally engaged with the one or more securing means 22 to be released through the opening of the one or more securing means 22.

Figure 5A:
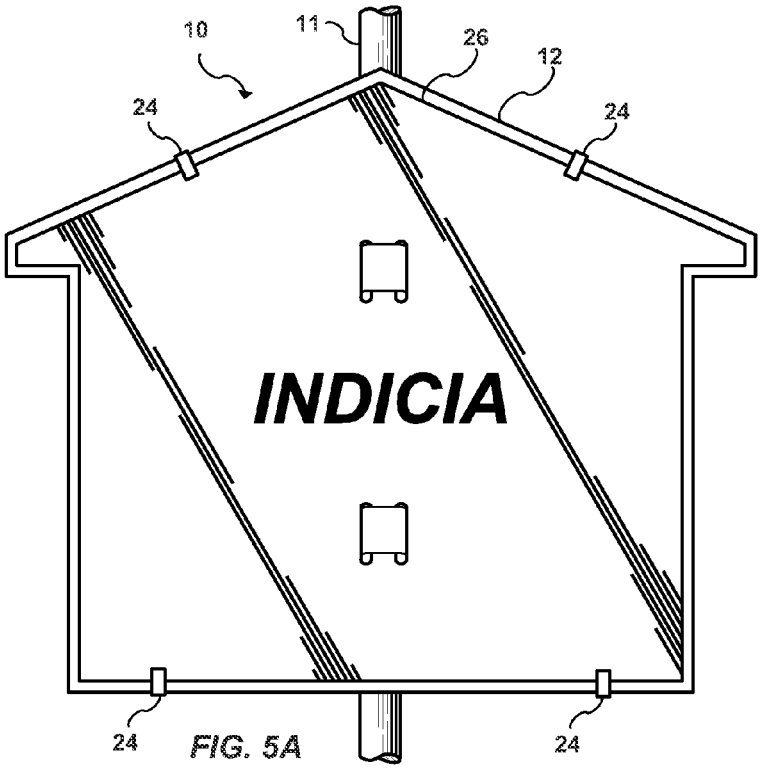
FIG. 5A shows a front view of a temporary reusable sign apparatus illustrating a substantially transparent protective sheet covering in accordance with an alternate embodiment of the present invention.
Figure 6A:
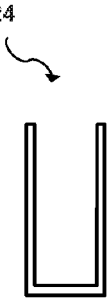
FIG. 6A shows a top view of a retaining portion in accordance with an embodiment of the present invention.
Figure 6B:
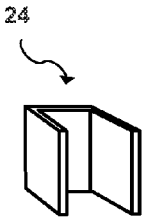
FIG. 6B shows a perspective view of a retaining portion of FIG. 6A in accordance with an embodiment of the present invention.
Figure 5B:
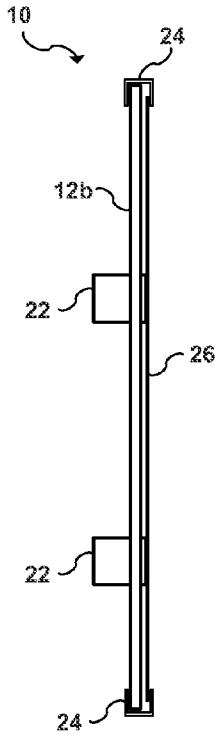
FIG. 5B shows a side view of the temporary reusable sign apparatus of FIG. 5A in accordance with an alternate embodiment of the present invention.

Referring to FIGS. 5A and 5B, a temporary reusable sign apparatus illustrating a substantially transparent protective sheet covering in accordance with an alternate embodiment of the present invention, is shown. According to this alternate embodiment, the temporary reusable sign apparatus 10 includes a sign board 12, a securing means 22, a substantially transparent protective sheet 26, and one or more attachment means 24. The one or more attachment means 24 are configured to attach the substantially transparent protective sheet 26 to sign board 12. As discussed above, the front side 12*a* of the sign board 12 includes a display area adapted to receive display indicia 13. The display area is comprised of a dry-erasable marker surface capable of receiving indicia 13 from a dry erase marker to write relevant information, and which is easily erasable. Unfortunately, indicia 12 consisting of dry-erasable marker markings is susceptible to moisture, which may cause the dry-erasable marker markings to bleed or run. The substantially transparent protective sheet 26 is therefore configured, in an operational position, to shield the display area of the sign board 12, including any indicia 13, from weather elements, such as rain, sleet, mud, and the like. The substantially transparent protective sheet 26 may include any transparent material including, without limitation, plastic, plexi-glass, glass, saran wrap, and the like.

According to one possible embodiment, the one or more attachment means are substantially u-shaped connectors which are configured to slide over and frictionally engage the sign board 12 and the substantially transparent protective sheet 26, thereby protecting the display area of the sign board 12 from the weather elements. It is understood that other attachment means are possible, including, without limitation, hooks, Velcro®, zippers, fasteners within the scope of the present invention.

Figure 5C:
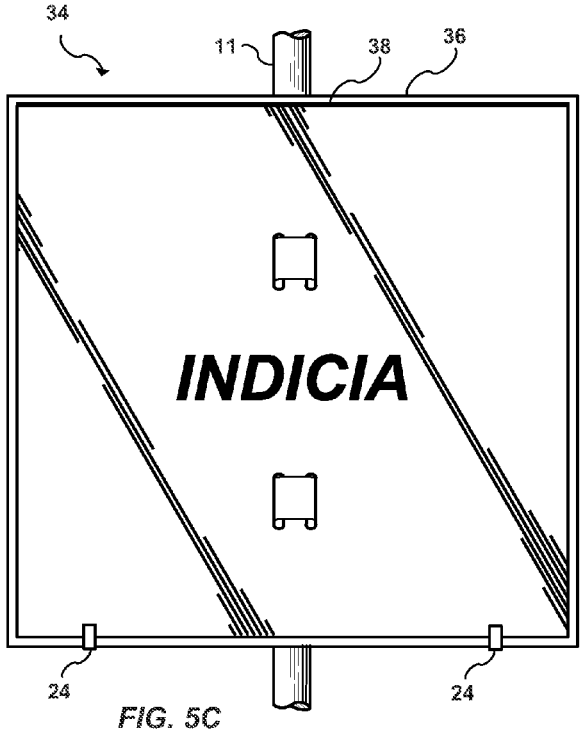
FIG. 5C shows a front view of a temporary reusable sign apparatus illustrating a substantially transparent protective sheet covering in accordance with an alternate embodiment of the present invention.

Referring to FIG. 5C, a temporary reusable sign apparatus illustrating a substantially transparent protective sheet covering in accordance with another alternate embodiment of the present invention, is shown. According to this alternate embodiment, the temporary reusable sign apparatus 34 includes a rectangular sign board 36 and a substantially transparent protective sheet 38 permanently bonded or joined to an upper portion of the display area of the sign board 12. Optionally, the temporary reusable sign apparatus 34 may include one or more attachment means 24. It is understood that at least a portion of the substantially transparent protective sheet 26 may be permanently bonded or joined to any portion of the sign board 12. It is also understood that other means of protecting the display area of the sign board 12 from the weather elements is also possible within the scope of the invention.

Although exemplary sizes and shapes of the temporary reusable sign apparatus 10 are illustrated in FIGS. 1A-6B, it is understood that the size and shapes of the temporary reusable sign apparatus 10 can also be changed and modified within the scope of the present invention. For example, without limitation, the temporary reusable sign apparatus 10 may be any shape, including without limitation, an arrow shape, a rectangular shape, a square shape, a circular shape, an oval shape, a triangular shape, and the like. The temporary reusable sign apparatus 10 may also be any size from small to large and may have any number of openings (14, 16, 18 and 20) on the front side 12*a* of the sign board, or none at all. It is further understood that the temporary reusable sign apparatus 10 may include any number of securing means (22, 30, 34, and 36).

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

Obviously, many other modifications and variations of the present invention are possible in light of the above teachings. The specific embodiments discussed herein are merely illustrative, and are not meant to limit the scope of the present invention in any manner. It is therefore to be understood that within the scope of the disclosed concept, the invention may be practiced otherwise then as specifically described.

The invention claimed is:

1. A temporary reusable sign apparatus, comprising:

a substantially flat sign board having two or more openings and front and rear sides, wherein the front side includes a dry-erasable marker surface configured to receive one or more indicia; and a securing means for securing the substantially flat sign board to a supporting structure, wherein the securing means is configured to deflectably receive and thereby frictionally engage a portion of the supporting structure, wherein the securing means is substantially c-shaped and having two distal end portions defining an opening, the two or more openings of the flat sign board receive the securing means there through, and wherein the two distal end portions of the securing means are configured to deflectably receive through the opening and thereby frictionally engage a portion of the supporting structure.

2. The apparatus of claim 1, wherein the securing means comprises a portion of PVC pipe formed into a substantially c-shape.

3. The apparatus of claim 1, wherein the rear side includes a hardened material configured to withstand the wind without collapsing.

4. The apparatus of claim 3, wherein the hardened material is at least one selected from group one consisting of a high density fiberglass, fiberboard, plastic, composite, and metal.

5. The apparatus of claim 1, wherein the securing means is at least one selected from group one consisting of a PVC, plastic, and metal.

6. The apparatus of claim 1, wherein the one or more indicia comprises text.

7. The apparatus of claim 1, wherein the one or more indicia comprises graphics.

8. The apparatus of claim 1, wherein the front and rear sides comprise a unitary piece.

9. The apparatus of claim 1, wherein the front and rear sides comprise separate pieces.

10. The apparatus of claim 9, wherein from and rear sides are joined together by means of at least one selected from group one consisting of a solvent cement, a water-based contact cement, a white glue (PVA), an epoxy, a semi-rigid adhesive, a rigid adhesive, an adhesive tape, magnets, magnets, and hook and loop fasteners.

11. The apparatus of claim 1, wherein the dry-erasable marker surface is at least one selected from group one consisting of dry erase markerboard laminate, and porcelain markerboard.

12. The apparatus of claim 1, further comprising a substantially transparent protective sheet attached to the front side of the substantially flat sign board.

13. The apparatus of claim 12, further comprising one or more attachment means, wherein the one or more attachment means are configured to attach the substantially transparent protective sheet to the front side of the substantially flat sign board.

14. The apparatus of claim 13, wherein the one or more attachment means comprise substantially u-shaped clips.

15. The apparatus of claim 13, wherein the one or more attachment means comprise a permanent bonding of at least a portion of the substantially transparent protective sheet to at least a portion of the front side of the substantially flat sign board.

16. The apparatus of claim 1, wherein the substantially flat sign board comprises an arrow shape.

17. The apparatus of claim 1, wherein the substantially flat sign board comprises at least one selected from group one consisting of a rectangular shape, a triangular shape, circular shape, and an oval shape.

* * * * *